United States Patent [19]

Cook

[11] 4,039,012

[45] Aug. 2, 1977

[54] NON-REBOUND HAMMER

[75] Inventor: William H. Cook, Indianapolis, Ind.

[73] Assignee: C. E. S., Inc., Indianapolis, Ind.

[21] Appl. No.: 648,415

[22] Filed: Jan. 12, 1976

[51] Int. Cl.[2] ..... B25D 1/00

[52] U.S. Cl. ..... 145/29 R; 145/29 B; 145/36

[58] Field of Search ..... 145/29 R, 29 B, 36, 145/29 A, 29 C

[56] References Cited

U.S. PATENT DOCUMENTS

| | | | |
|---|---|---|---|
| 1,499,501 | 7/1924 | Boykin | 145/29 R |
| 1,823,016 | 9/1931 | Widman | 145/36 UX |
| 2,566,517 | 9/1951 | Dicks | 145/36 |
| 2,808,861 | 10/1957 | Hughes | 145/36 |
| 3,115,912 | 12/1963 | Harris | 145/29 R |
| 3,130,762 | 4/1964 | Kerr | 145/29 B |
| 3,605,832 | 9/1971 | Stephens | 145/29 B |
| 3,792,725 | 2/1974 | Burgeson | 145/29 R |
| 3,844,321 | 10/1974 | Cook | 145/29 R |

FOREIGN PATENT DOCUMENTS

| | | | |
|---|---|---|---|
| 225,938 | 2/1959 | Australia | 145/29 B |
| 664,536 | 6/1963 | Canada | 145/29 B |
| 377,293 | 6/1964 | Switzerland | 145/29 B |
| 865,287 | 4/1961 | United Kingdom | 145/29 |
| 1,287,692 | 9/1972 | United Kingdom | 145/29 B |
| 1,291,845 | 10/1972 | United Kingdom | 145/29 R |
| 5,648 | 3/1911 | United Kingdom | 145/36 |

*Primary Examiner*—James L. Jones, Jr.
*Assistant Examiner*—J. T. Zatarga
*Attorney, Agent, or Firm*—Jenkins, Coffey & Hyland

[57] ABSTRACT

A hammer having a hollow cylindrical head filled with recoil inhibiting pellets such as lead shot, and having its ends closed by metallic end caps each having an exterior impact surface. A handle-forming skeletal rod is centrally connected to the head, and said head and rod are encased within a unitary resilient encasement leaving the two impact surfaces exposed.

2 Claims, 4 Drawing Figures

NON-REBOUND HAMMER

BACKGROUND OF THE INVENTION

This invention relates to impact tools such as hammers. More specifically, this invention relates to an improved hammer having exposed metallic impact surfaces with the remainder of said hammer covered by a unitary resilient encasement.

Hammers of many sizes and shapes are available throughout the prior art, and typically comprise a handle connected to a head having at least one impact surface. The specific construction of the hammer handle and head, and even the striking surface, varies widely according to the desired specialized use of the hammer. That is, hammers for some applications are provided with heads formed from steel or the like to provide hard metallic impact surfaces. See, for example, U.S. Pat. No. 3,341,261. Alternately, for other applications hammers are provided with heads formed from Babbitt or other soft compositions such as lead or rubber to provide soft, non-marring impact surfaces. See, for example, U.S. Pat. No. 2,894,550. Further, some hammers are provided with pellet-filled heads for reducing dangerous recoil upon impact. See, for example, U.S. Pat. Nos. 2,604,914 and 2,737,216.

Another specialized hammer construction comprises a skeletal hammer head and handle wholly received within a resilient encasement to provide soft impact surfaces. See, for example, U.S. Pat. Nos. 52,696 and 3,844,321. Such encased hammers are advantageous in that they cannot cause sparking when brought in contact with metallic surfaces, and they do not scratch or otherwise mar surfaces during use. Further, hammers having a resilient exterior coating are not susceptible to undesirable chipping during use and thereby have an improved life span over hammers having heads formed from Babbitt or the like.

Resilient encasements have not been used, however, with hammers requiring steel or other hard metal impact surface since it is necessary to keep the hard impact surface exposed. As a result, such hammers are therefore left with extensive exposed steel surface areas over the hammer head, and often over the handle too. These exposed steel surface areas can chip, create sparks, or scratch surface finishes both during use and when the hammer is put down. That is, when the hammer is used near other machinery, etc., portions of the hammer other than the impact surface can contact the machinery to cause sparks, chips, and scratches. Similarly, when the hammer is put down, the portions of the hammer other than the impact surface can contact other metal surfaces to cause sparks, etc.

It is desirable, therefore, to provide an improved hammer having exposed steel or other hard-faced impact surfaces wherein the remainder of the hammer is covered by a unitary, resilient encasement. Moreover, it is desirable to provide such an improved hammer which is quickly and easily assembled, made from economical materials, and of durable construction.

SUMMARY OF THE INVENTION

In accordance with the invention, a hammer is provided with a hollow cylindrical head closed at its rear end by an integral end cap having a rearwardly presented impact surface. The hollow head is filled with lead shot pellets for inhibiting hammer recoil, and the front end thereof is closed by an end cap threadably received over the hollow head and defining a forwardly presented impact surface. A handle-forming skeletal rod is centrally received through the hollow head normal to the longitudinal axis thereof, and is fixed thereto as by welding. A unitary resilient encasement is molded about the hollow head and the skeletal rod to leave exposed only the end caps at the front and rear of the head.

BRIEF DESCRIPTION OF THE DRAWINGS

The accompanying drawings illustrate the invention. In such drawings.

DETAILED DESCRIPTION OF THE PREFERRED EMBODIMENT

Figure 1:
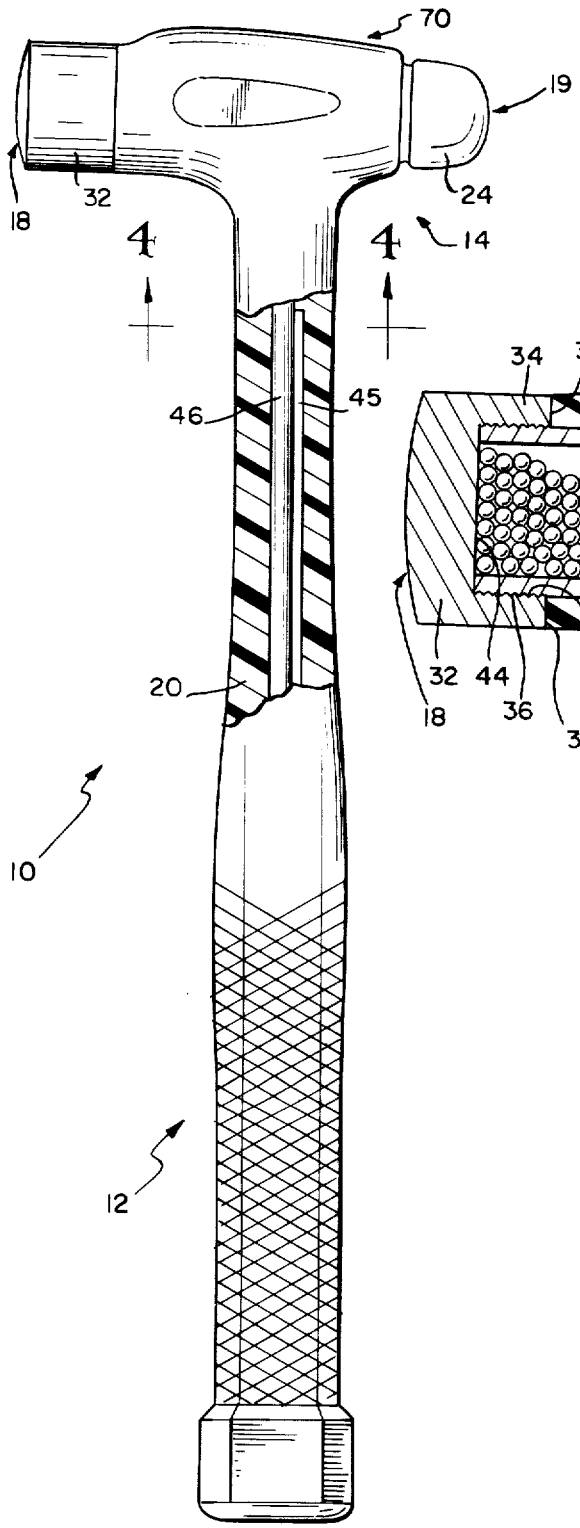
FIG. 1 is a side elevating of a hammer embodying the invention with portions thereof being broken away.

A hammer 10 of this invention is shown in FIG. 1, and generally comprises a handle portion 12 joined to a head portion 14. The head portion 14 has forwardly and rearwardly presented metallic impact surfaces 18 and 19, respectively. The exterior of the remainder of the handle and head portions 12 and 14 comprises a unitarily molded resilient encassement 20.

Figure 2:
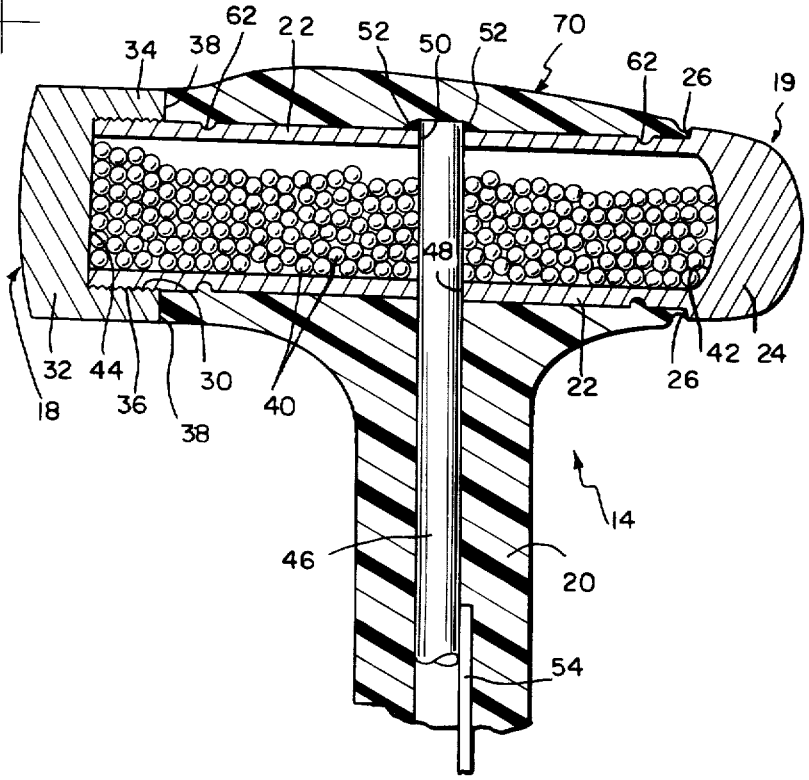
FIG. 2 is an enlarged fragmented vertical section of the head portion of the hammer of FIG. 1.
Figure 3:
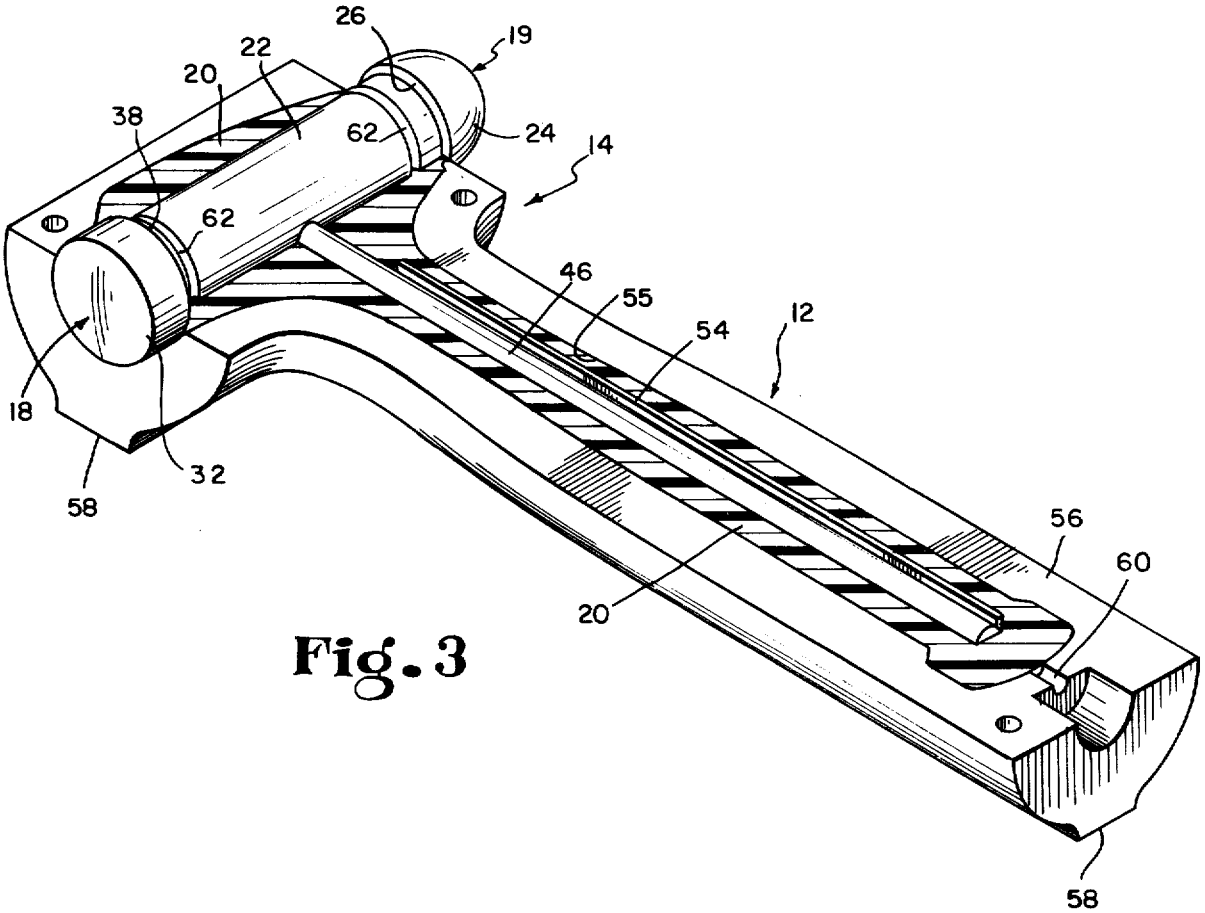
FIG. 3 is a perspective view of part of a mold for use in making the hammer of FIG. 1.
Figure 4:
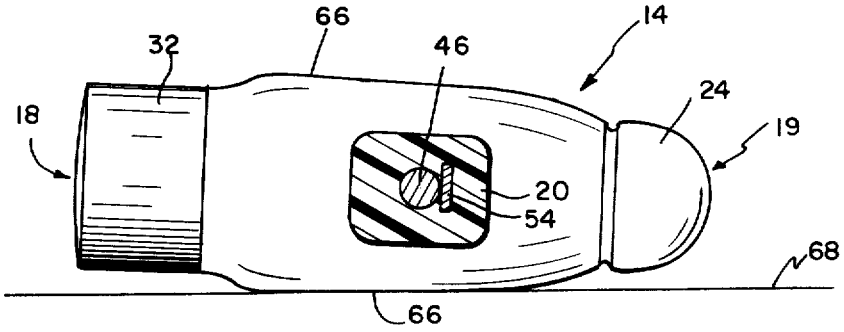
FIG. 4 is an enlarged horizontal section taken on the line 4—4 of FIG. 1, and showing the head portion of the hammer resting upon a supporting surface.

The head portion 14 is shown in detail in FIGS. 2–4, and comprises a hollow cylindrical core 22 formed from a hardened steel or the like. The rear of the core 22 is closed by a rear end cap 24 integrally joined thereto and extending outwardly from the core periphery to provide a peripherally extending, forwardly presented abutment 26. Alternately, if desired, the rear end cap 24 can be removably connected to the core in any suitable manner. The exterior surface of the rear end cap 24 extends rearwardly from the abutment 26 and gradually curves inwardly to form a ball peen impact surface which defines the rearwardly presented impact surface 19.

The front end of the core 22 is open, and has threads 30 formed about the outer periphery thereof. A front end cap 32 has a cylindrical side wall 34 with internally formed threads 36 for matingly engaging the core threads 30. Thus, the front end cap 32 is receivable over the core 22 to close the core front and to provide a rearwardly presented peripheral abutment 38. Said front end cap 32 is formed from a hardened steel, and desirably from the same material as the core 22. As shown in FIG. 2, the front end cap 32 has a slightly convexed, forwardly presented surface which comprises the forwardly presented impact surface 18 for the hammer.

Before the front end cap 32 is received over the core 22, said core is substantially filled with a quantity of pellets 40 such as small lead shot. These pellets add weight to the hammer head, and serve to effectively absorb impact forces during use to inhibit impact recoil of the hammer. That is, when the ball peen impact surface 19 is struck against an object, the pellets 40 slide over each other and against the inside face 42 of the rear end cap 24 to absorb impact forces and substantially eliminate hammer rebound. Similarly, when the front impact surface 18 is struck against an object, the pellets 40 slide over each other and against the inside face 44 of the front end cap 32 to substantially eliminate hammer rebound. In practice, the pellets 40 are conveniently coated with a lubricating substance such as liquid silicone to improve the pellets sliding action and thereby improve the ability of the pellets to inhibit recoil. Lubrication of the pellets also reduces sliding friction between said pellets to prevent undesirable heat build-up during use which could otherwise melt the pellets into a single ball.

The cylindrical core 22 has a rigid rod 46 of steel or the like connected thereto to provide a skeletal basis for the hammer handle portion 12. As shown in FIG. 2, the handle rod 46 is disposed perpendicularly to the longitudinal axis of the core 22, and has one end centrally received through aligned lower and upper holes 48 and 50, respectively, in the core. The rod 46 is attached to the core adjacent the upper hole 50 by welds 52. With this construction, a small amount of shock-absorbing flexibility is available between the handle rod 46 and the core at the lower core hole 48, and this flexibility has been found to substantially increase the working life of the hammer.

The handle rod 46 has a locking strip 54 formed from metal or the like connected thereto as by spot welding. The locking strip 54 has a rectangular cross section, and extends alongside the handle rod 46 for a substantial portion of the length thereof. Said strip is provided to disrupt the circular periphery of rod 46, and thereby provide a discontinuous skeletal surface for locking engagement with the covering resilient encasement 20. This prevents twisting of the handle rod 46 or the head core 22 within the encasement 20 to increase the useful life of the hammer.

The resilient encasement 20 is molded about the core 22 and the handle rod 46 by means of a two-part mold, with one of said mold parts being shown in FIG. 3. As shown, the interconnected handle rod 46 and core 22 are together placed within a cavity 55 in a complementary-shaped mold half 56 with the rear end cap 24 and the front end cap 32 disposed outside the mold. The rod and core are appropriately suspended within the mold half 56 by means of small locating pins (not shown), and a second mold half is placed over the half 56. The two mold halves are then fastened together by clamps or the like (not shown) engaging flat surfaces 58 on the mold halves, and the resilient encasement in liquid form is introduced into the mold through a sprue hole 60. The liquid encasement material flows about the handle rod 46 and core head 22 to surround said core and to come against the forwadly and rearwardly presented abutments 26 and 38 of the rear and front end caps 24 and 32, respectively. This leaves the respective rear and front impact surfaces 16 and 18 exposed while encasing the remainder of the core 22. A pair of axially spaced circumferential grooves 62 are formed in the core 22 for accepting the liquid encasement material to help lock the cured encasement in position on the core.

The liquid encasement material also fills the mold cavity 55 about the handle rod 46 and its associated locking strip 54. The filled mold is then subjected to appropriate curing or setting conditions, such as elevated temperatures within a cure oven, to allow the liquid encasement material to reach the desired solid state. Thus, upon separation of the mold halves, the hammer comprises a pair of exposed metallic impact surfaces 16 and 18 with the remaining surface area covered by the unitary resilient encasement 20.

As shown in FIG. 4, the shape of the resilient encasement 20 about the head core 22 is carefully controlled so that the encasement 20 is wider than the diameter of either end cap 24 or 32. In addition, the encasement 20 is molded to have flat cheek portions 66 disposed laterally outwardly from the sides of the end caps 24 and 32 to allow the hammer to be placed on a flat supporting surface 68 without the metal end caps touching the supporting surface. With this construction, metal to metal contact is avoided. Similarly, as shown in FIG. 1, the encasement 20 is crowned upwardly, as at 70, from the uppermost extent of the metal end caps 24 and 32 to further reduce the possibility of metal to metal contact at the top of the hammer.

In practice, the resilient encasement 20 comprises a urethane composition, because such compositions have been found to be durable and extremely long-lived. The composition is desirably supplemented with an appropriate hardener, such as isocyanate, to allow close control of the resulting encasement.

I claim:

1. A hammer comprising a hollow cylindrical core having front and rear ends, first and second metal end caps respectively closing the front and rear ends of said core and each having an impact surface formed thereon, said first end cap being threadably received over the front end of said core and said second end cap being formed integrally with said core at the rear end thereof, said end caps providing a pair of opposed abutments extending peripherally and radially outwardly from said core, recoil inhibiting pellets carried in said core between said end caps, a handle member having one of its ends extending through and connected to said core between said end caps and its opposite end projecting outwardly perpendicular to the longitudinal axis of said core to form a handle for the hammer, and a unitary resilient encasement covering said handle member and said core and engaging said abutments on said end caps to leave said impact surfaces exposed, said encasement having a central portion encircling said core between said end caps with a diameter larger than the diameter of said end caps, said core and said handle member each including locking means for lockingly engaging said encasement.

2. A hammer as set forth in claim 1 wherein said resilient encasement includes substantially flat cheek portions disposed on opposite sides of said core and laterally outwardly of said end caps for contacting a supporting surface when the hammer is placed on the supporting surface to prevent said end caps from contacting and damaging said supporting surface.

* * * * *